US009663731B2

(12) United States Patent
Wegerer et al.

(10) Patent No.: US 9,663,731 B2
(45) Date of Patent: May 30, 2017

(54) PROCESSES AND APPARATUSES FOR PRODUCING AROMATIC COMPOUNDS FROM A NAPHTHA FEED STREAM

(71) Applicant: UOP LLC, Des Plaines, IL (US)

(72) Inventors: David A. Wegerer, Lisle, IL (US); Keyur Y. Pandya, Elgin, IL (US)

(73) Assignee: UOP LLC, Des Plaines, IL (US)

( * ) Notice: Subject to any disclaimer, the term of this patent is extended or adjusted under 35 U.S.C. 154(b) by 389 days.

(21) Appl. No.: 13/922,030

(22) Filed: Jun. 19, 2013

(65) Prior Publication Data

US 2014/0374312 A1 Dec. 25, 2014

(51) Int. Cl.
*C10G 59/02* (2006.01)
*C10G 35/02* (2006.01)

(52) U.S. Cl.
CPC ..... *C10G 59/02* (2013.01); *C10G 35/02* (2013.01); *C10G 2400/30* (2013.01)

(58) Field of Classification Search
CPC .... C10G 2400/30; C10G 35/02; C10G 35/24; C10G 59/02
See application file for complete search history.

(56) References Cited

U.S. PATENT DOCUMENTS 2,354,355 A 7/1944 Abrams et al.
2,779,714 A 1/1957 Keith
3,128,242 A 4/1964 Bergstrom et al.
3,392,107 A * 7/1968 Pfefferle ..... C10G 35/085 208/138
4,032,431 A * 6/1977 Weisz ..... C10G 59/02 208/62
4,441,988 A 4/1984 Irvine
6,180,846 B1 1/2001 Dandekar et al.
6,274,101 B1 8/2001 Sechrist
6,869,578 B1 3/2005 Hebert et al.
2012/0277502 A1 11/2012 Gajda et al.
2012/0277503 A1 11/2012 Wegerer et al.
2013/0158316 A1 6/2013 Moser et al.
2013/0158317 A1 6/2013 Moser et al.
2013/0158320 A1 6/2013 Moser et al.

FOREIGN PATENT DOCUMENTS

WO 8907586 A1 8/1989

OTHER PUBLICATIONS

Verheyen, W, et al., Design of Flexible Heat Exchanger Network for Multi-Period Operation, 2006, Chemical Engineering Science, pp. 7730-7753.*

* cited by examiner

*Primary Examiner* — Renee Robinson
*Assistant Examiner* — Derek Mueller

(57) ABSTRACT

Processes and apparatuses for producing aromatic compounds from a naphtha feed stream are provided herein. In an embodiment, a process for producing aromatic compounds includes heating the naphtha feed stream to produce a heated naphtha feed stream. The heated naphtha feed stream is reformed within a plurality of reforming stages that are arranged in series to produce a downstream product stream. The plurality of reforming stages is operated at ascending reaction temperatures. The naphtha feed stream is heated by transferring heat from the downstream product stream to the naphtha feed stream to produce the heated naphtha feed stream and a cooled downstream product stream.

19 Claims, 3 Drawing Sheets

PROCESSES AND APPARATUSES FOR PRODUCING AROMATIC COMPOUNDS FROM A NAPHTHA FEED STREAM

TECHNICAL FIELD

The technical field generally relates to processes and apparatuses for reforming a naphtha feed stream, and more particularly relates to processes and apparatuses for reforming naphtha feed streams to produce aromatic compounds with minimal energy expenditure.

BACKGROUND

The reforming of naphtha feed streams is an important process for producing useful products, especially for the production of gasoline. In particular, reforming naphtha feed streams is useful to produce aromatic compounds and, thus, to increase the octane value of the naphtha feed streams. To reform the naphtha feed streams, the naphtha feed streams are generally passed to a plurality of reformers that are arranged in series, with conventional systems operated at a substantially isothermal temperature profile based upon inlet temperature at each reformer.

More recently, development of reforming schemes have focused upon maximizing production of aromatics compounds and minimizing production of lower value non-aromatic by-products through manipulation of the reaction rates within the reformers in a manner that favors selectivity to desirable aromatic compounds. However, such reforming schemes are energy-intensive and often require inter-reformer heating.

Accordingly, it is desirable to provide processes and apparatuses for producing aromatic compounds from a naphtha feed stream that maximizes production of aromatics compounds while minimizing energy requirements for effectively reforming the naphtha feed stream. Furthermore, other desirable features and characteristics of the present invention will become apparent from the subsequent detailed description of the invention and the appended claims, taken in conjunction with the accompanying drawings and this background of the invention.

BRIEF SUMMARY

Processes and apparatuses for producing aromatic compounds from a naphtha feed stream are provided herein. In an embodiment, a process for producing aromatic compounds includes heating the naphtha feed stream to produce a heated naphtha feed stream. The heated naphtha feed stream is reformed within a plurality of reforming stages that are arranged in series to produce a downstream product stream. The plurality of reforming stages is operated at ascending reaction temperatures. The naphtha feed stream is heated by transferring heat from the downstream product stream to the naphtha feed stream to produce the heated naphtha feed stream and a cooled downstream product stream.

In another embodiment, a process for producing aromatic compounds from a naphtha feed stream includes providing a plurality of reformers including a first reformer and a second reformer. The reformers are arranged in series. The naphtha feed stream is heated to a first reaction temperature to produce a heated naphtha feed stream. The heated naphtha feed stream is passed to the first reformer, which is operated at the first reaction temperature, to produce a first intermediate stream. The first intermediate stream is passed to the second reformer, which is operated at a second reaction temperature that is higher than the first reaction temperature, to produce a second intermediate stream. A downstream product stream is produced from the second intermediate stream using a terminal reformer of the plurality of reformers. The naphtha feed stream is heated by transferring heat from the downstream product stream to the naphtha feed stream to produce the heated naphtha feed stream and a cooled downstream product stream, and the naphtha feed stream is heated to the first reaction temperature exclusively through transferring heat from the downstream product stream to the naphtha feed stream.

In another embodiment, an apparatus for producing aromatic compounds from a naphtha feed stream includes a plurality of reformers including a first reformer and a second reformer. The reformers are arranged in series, and the plurality of reformers is adapted to produce a downstream product stream from a terminal reformer of the plurality of reformers. A first heat exchanger is disposed upstream of the first reformer and is adapted to transfer heat from the downstream product stream to the naphtha feed stream. A first heater is disposed between the first reformer and the second reformer for heating a first intermediate stream that is produced by the first reformer. The apparatus is free from a heater disposed between the first heat exchanger and the first reformer.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description.

Processes and apparatuses for producing aromatic compounds from a naphtha feed stream are provided herein. The processes and apparatuses maximize production of aromatics compounds through the use of a plurality of reforming stages that are arranged in series and that are operated at ascending reaction temperatures to produce a downstream product stream while minimizing energy requirements for effectively reforming the naphtha feed stream. In particular, energy requirements are minimized by transferring heat from the downstream product stream to a naphtha feed stream. Due to operation of the plurality of reforming stages at ascending reaction temperatures, the downstream product stream is produced having a significantly higher temperature than the naphtha feed stream and a first reforming stage is operated at a lower temperature than subsequent reforming stages. As such, efficient transfer of heat from the downstream product stream to the naphtha feed stream is possible. Further, it is possible (although not required) to heat the naphtha feed stream to a first reaction temperature at which the first reforming stage is operated by transferring heat from the downstream product stream to the naphtha feed stream, thereby eliminating a need for a heater that requires energy from external to the process (such as a combustion or electric heater) to heat the naphtha feed stream prior to passing the naphtha feed stream to the first reforming stage.

Figure 1:
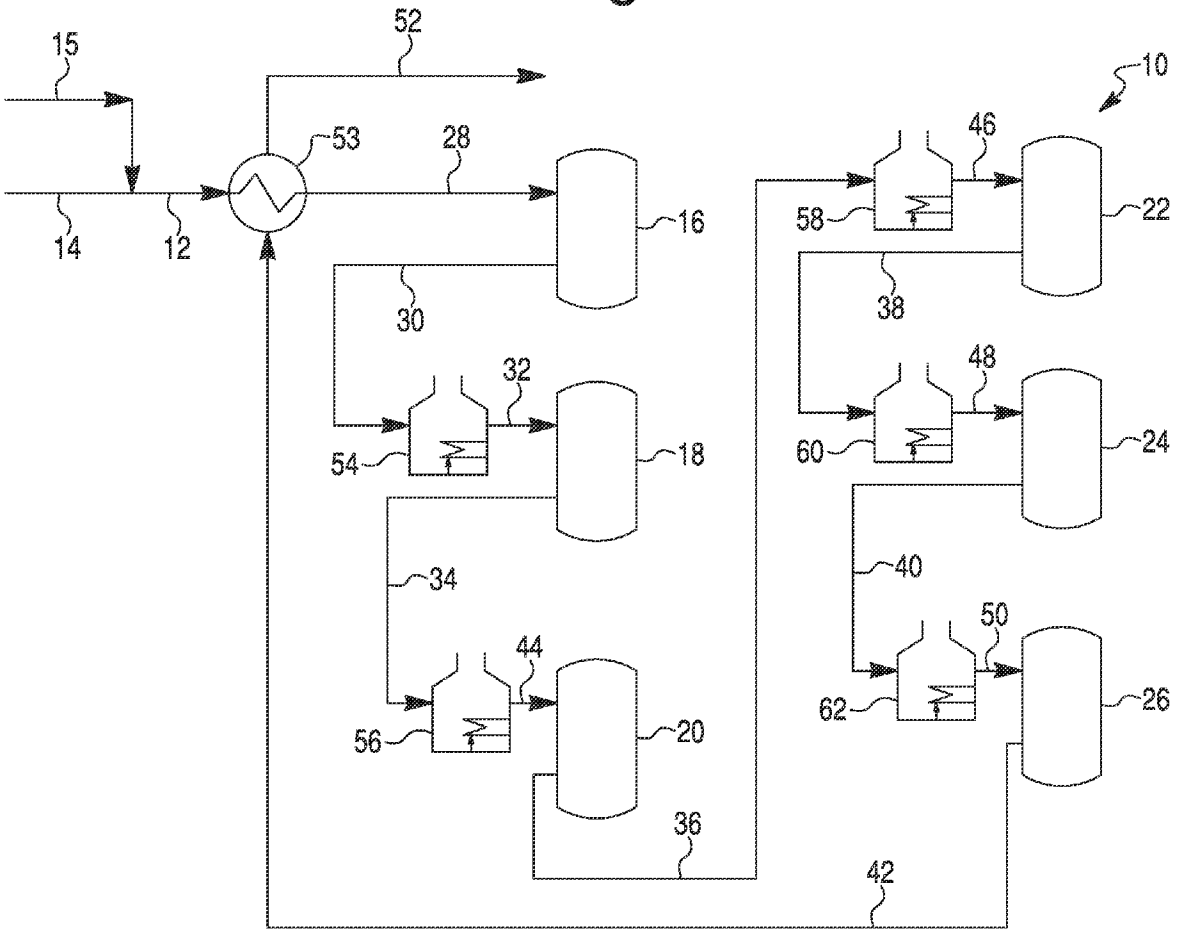
FIG. 1 is a schematic diagram of an apparatus and a process for producing aromatic compounds from a naphtha feed stream in accordance with an exemplary embodiment.

An embodiment of a process for producing aromatic compounds will now be addressed with reference to an exemplary apparatus 10 for producing aromatic compounds as shown in FIG. 1. In accordance with the process and as shown in FIG. 1, a naphtha feed stream 12 is provided. The naphtha feed stream generally has an initial boiling point of about 80° C. and an end boiling point of about 205° C. The naphtha feed stream 12 may include fresh feed 14, recycled feed 15 that includes hydrogen and that may further include paraffins and other non-aromatics that are separated from aromatic compounds after reforming, or a combination of fresh feed 14 and recycled feed 15. The naphtha feed stream 12 may include many different hydrocarbon compounds, and reforming of the compounds generally proceeds along numerous pathways. The reaction rates of the various hydrocarbon compounds vary with temperature, and the Arrhenius equation captures the relationship between the reaction rate and temperature. The reaction rate is controlled by the activation energy for a particular reaction, and with the many reactions that occur during reforming, there are many, dissimilar activation energies for the different reactions.

In accordance with the processes described herein, the naphtha feed stream 12 is reformed within a plurality of reforming stages that are arranged in series to produce a downstream product stream 42. The reforming process is a common process in the refining of petroleum, and is usually used for increasing the amount of gasoline. The reforming process comprises mixing a stream of hydrogen and a hydrocarbon mixture, such as the naphtha feed stream 12, and contacting the resulting stream with a reforming catalyst. The reforming reaction converts paraffins and naphthenes through dehydrogenation and cyclization to aromatics. The dehydrogenation of paraffins can yield olefins, and the dehydrocyclization of paraffins and olefins can yield aromatics.

Suitable reforming catalysts generally include a metal on a support. The support can include a porous material, such as an inorganic oxide or a molecular sieve, and a binder with a weight ratio from 1:99 to 99:1. The weight ratio may be from about 1:9 to about 9:1. Inorganic oxides used for support include, but are not limited to, alumina, magnesia, titania, zirconia, chromia, zinc oxide, thoria, boria, ceramic, porcelain, bauxite, silica, silica-alumina, silicon carbide, clays, crystalline zeolitic aluminasilicates, and mixtures thereof. Conventional porous materials and binders may be used. Suitable metals may include one or more Group VIII noble metals, and include platinum, iridium, rhodium, and palladium. In an embodiment, the reforming catalyst contains an amount of the metal from about 0.01% to about 2% by weight, based on the total weight of the reforming catalyst. The reforming catalyst can also include a promoter element from Group IIIA or Group WA. These metals include gallium, germanium, indium, tin, thallium and lead.

In an embodiment, the plurality of reforming stages includes a first reforming stage, a second reforming stage, and one or more additional reforming stages. For example and as shown in FIG. 1, a plurality of reformers 16, 18, 20, 22, 24, 26 may be provided, with a reforming stage represented in each respective reformer 16, 18, 20, 22, 24, 26. Thus, in the embodiment shown in FIG. 1, the apparatus 10 includes six reformers 16, 18, 20, 22, 24, 26 and the process includes reforming the naphtha feed stream 12 through six reforming stages. However, it is to be appreciated that any number of reformers may be employed in other embodiments. Further, although not shown, it is to be appreciated that each reformer can include one or more reaction beds in accordance with conventional reformer design. In an embodiment, the reformers 16, 18, 20, 22, 24, 26 may be moving bed reaction vessels that contain moving catalyst beds (not shown), and a moving bed regeneration vessel (also not shown) can be employed in conjunction with the reformers 16, 18, 20, 22, 24, 26. In an embodiment, moving catalyst beds that employed in the reformers 16, 18, 20, 22, 24, 26 can be countercurrent, cocurrent, crosscurrent, or a combination thereof, and the moving catalyst bed can be any suitable shape, such as rectangular, annular or spherical. It is to be appreciated that in other embodiments, the reformers 16, 18, 20, 22, 24, 26 may be fixed bed reaction vessels that contain fixed catalyst beds. In accordance with an exemplary process, the plurality of reforming stages are operated at ascending reaction temperatures, thereby making it is possible to manipulate the conversion of specific hydrocarbon compounds in the naphtha feed stream to desired products in the respective reforming stages, e.g., conversion of hexane to benzene. Operation of the plurality of reforming stages at ascending reaction temperatures, as referred to herein, means that at least the first reforming stage is operated at a lower temperature than all subsequent reaction stages, although it is to be appreciated that the sequential reaction stages after the first reaction stage can be operated at about the same temperature. For example, in an embodiment, the second reforming stage and the one or more additional reforming stages are operated at about the same reaction temperature. "About the same reaction temperature" means that the reaction temperatures of the second reforming stage and any subsequent reforming stages are preferentially the same, although insubstantial differences in reaction temperatures are permissible, e.g., differences in reaction stage inlet temperature of about 10° C. or less. It is also to be appreciated that each sequential reaction stage can be operated at a higher temperature than the immediately prior reaction stage. For example, in embodiments, the first reforming stage is operated at a first reaction temperature of from about 350° C. to about 480° C., the second reforming stage is operated at a second reaction temperature of from about 480° C. to about 530° C., and an additional reaction stage is operated at a third reaction temperature of from about 530° C. to about 570° C., provided that the sequential reaction temperatures are higher than the preceding reaction temperatures. Reaction temperatures of the reforming stages, as referred to herein, are the temperatures of feed streams immediately prior to passing into the respective reforming stages, i.e., reaction stage inlet temperatures. Operation of the plurality of reforming stages at ascending reaction temperatures effectively manipulates reaction rates of naphtha reforming reactants in a way that favors selectivity to desirable aromatic products in the various reforming stages based upon the particular content of the feed streams that are passed into the respective reforming stages. While using the same reforming catalyst in the various reforming stages, the reactions in the various reforming stages are controlled using the ascending reaction temperatures, which has the effect of minimizing unwanted by-products while maximizing yield of desirable aromatic compounds.

Reforming is a substantially endothermic reaction and results in a significant temperature decrease in the reforming stages, although different hydrocarbon compounds within the naphtha feed stream exhibit different endothermicity during reforming In accordance with the processes described herein, the reforming stages are operated with a non-isothermal temperature profile, with temperatures of streams into the reforming stages being higher than temperatures of streams produced from the reforming stages. To facilitate reforming, the naphtha feed stream 12 is heated to produce a heated naphtha feed stream 28 (which is compositionally similar to the naphtha feed stream 12 but has a higher temperature). In particular, the naphtha feed stream 12 is heated to the first reaction temperature at which the first reforming stage is operated. In an embodiment, the first reaction temperature is from about 350° C. to about 480° C., such as from about 425° C. to about 475° C. The heated naphtha feed stream 28 is then reformed in the first reforming stage that is operated at the first reaction temperature to produce a first intermediate stream 30. For example and as shown in FIG. 1, the heated naphtha feed stream 28 may be passed to the first reformer 16, with the first reformer 16 operated at the first reaction temperature to produce the first intermediate stream 30.

Due to the endothermic nature of the reactions in the respective reforming stages, heat is further added to each intermediate stream that is produced from upstream reforming stages prior to passing into each subsequent reforming stage to maintain the temperature of reaction or to increase temperatures to desired reaction temperatures for the particular reforming stages. In an embodiment, the first intermediate stream 30 is heated to produce a heated first intermediate stream 32, followed by reforming the heated first intermediate stream 32 in the second reforming stage. For example, the heated first intermediate stream 32 may be passed to the second reformer 18 after heating, with the second reformer 18 operated at a second reaction temperature that is greater than the first reaction temperature, as described above, and with the first intermediate stream 30 heated to the second reaction temperature. In an embodiment, the second reaction temperature is at least 50° C. higher than the first reaction temperature, such as at least 80° C. higher than the first reaction temperature.

Reforming the heated first intermediate stream 32 produces a second intermediate stream 34. The second intermediate stream 34 and any subsequent intermediate streams 36, 38, 40 (e.g., those produced from the various reformers 20, 22, 24 that are downstream of the first reformer 16 and the second reformer 18 and that are not a terminal reformer 26) are heated to form respective heated intermediate streams 44, 46, 48, 50 that are reformed in the one or more additional reforming stages (e.g., in the various reformers 20, 22, 24, 26). The downstream product stream 42 is produced from the second intermediate stream 34 within a terminal reforming stage of the plurality of reforming stages. For example, in an embodiment and as shown in FIG. 1, the downstream product stream 42 is produced from the second intermediate stream 34 using the terminal reformer 26. In this embodiment, the second intermediate stream 34 is further reformed prior to the terminal reforming stage that produces the downstream product stream 42.

The naphtha feed stream 12 is heated by transferring heat from the downstream product stream 42 to the naphtha feed stream 12 to produce the heated naphtha feed stream 28 and to further produce a cooled downstream product stream 52 (which is compositionally similar to the downstream product stream 42). For example, in an embodiment and as shown in FIG. 1, a first heat exchanger 53 is disposed between the downstream product stream 42 and the naphtha feed stream 12, upstream of the first reformer 16, and is adapted to transfer heat from the downstream product stream 42 to the naphtha feed stream 12. Because the downstream product stream 42 is produced from the terminal reforming stage, the endotherm exhibited in the terminal reforming stage is generally less than in upstream reforming stages and the downstream product stream 42 is generally at a higher temperature than any prior intermediate stream. In particular, the endotherm generally progresses from higher to lower between the various reforming stages, and a greater endotherm results in a greater temperature change. Thus, subsequent temperatures of the respective intermediate streams progress from lower to higher between the various reforming stages, with the temperatures of the respective intermediate streams being dependent upon both the reaction stage inlet temperatures and temperature changes due to the endotherm. Further, the downstream product stream 42 is generally separated through liquid-gas separation techniques, thereby necessitating substantial cooling of the downstream product stream 42 prior to any separation stage. As such, transfer of heat from the downstream product stream 42 to the naphtha feed stream 12 represents an efficient transfer of energy within the process. Further, because the first reaction temperature (i.e., the first reaction stage inlet temperature) is generally substantially less than reaction temperatures in subsequent reforming stages, the heated naphtha feed stream 28 may be passed to the first reforming stage in the absence of heating through energy input that is external to the process (e.g., through use of a combustion or electric heater). For example and as shown in FIG. 1, the naphtha feed stream 12 may be heated to the first reaction temperature exclusively through transferring heat from the downstream product stream 42 to the naphtha feed stream 12. Although not shown, it is to be appreciated that the naphtha feed stream 12 may also be heated with energy from within the process that is provided by sources other than the downstream product stream 42.

In embodiments as alluded to above, and as shown in FIG. 1, the first intermediate stream 30, the second intermediate stream 34, and any subsequent intermediate streams 36, 38, 40 are also heated to produce respective heated intermediate streams 32, 44, 46, 48, 50. In an embodiment and as shown in FIG. 1, the intermediate streams 30, 34, 36, 38, 40 are heated with energy from a source that is external to the process. For example, in an embodiment and as shown in FIG. 1, the first intermediate stream 30 is heated with a first heater 54, which may be any type of heater that provides heat using energy from a source that is external to the process (e.g., electricity, fuel, or any other energy that is not recovered from the process). Likewise, respective heaters 56, 58, 60, 62 may be employed to heat the subsequent intermediate streams 34, 36, 38, 40 that are shown in FIG. 1. Because the reforming stages that are downstream of the first reforming stage are generally operated at significantly higher temperatures than the first reforming stage, transfer of heat from the downstream product stream 42 to the intermediate streams 30, 34, 36, 38, 40 may not yield as much process efficiency as transferring heat from the downstream product stream 42 to the naphtha feed stream 12. As such, in an embodiment and as shown in FIG. 1, the first intermediate stream 30, the second intermediate stream 34, and any subsequent intermediate streams 36, 38, 40 may be exclusively heated with energy from the source that is external to the process. In other embodiments and as described in further detail below, additional transfer of heat from the downstream product stream 42 may be effected to yield further process efficiency.

Figure 2:
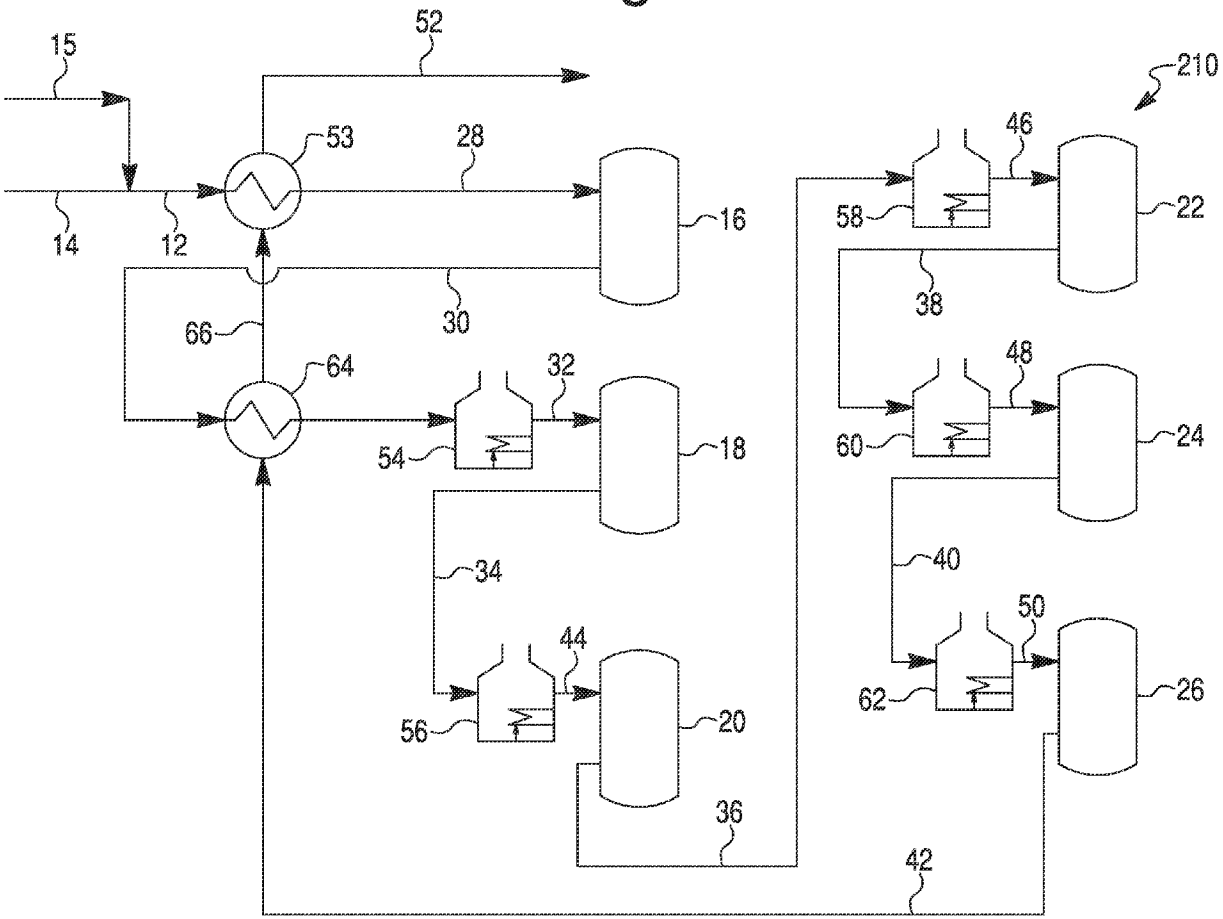
FIG. 2 is a schematic diagram of an apparatus and a process for producing aromatic compounds from a naphtha feed stream in accordance with another exemplary embodiment.

Another embodiment of a process for producing aromatic compounds from a naphtha feed stream 12 will now be addressed with reference to another exemplary apparatus 210 for producing aromatic compounds as shown in FIG. 2. In this embodiment, the process is conducted in the same manner as the process that is described above in the context of the apparatus 10 shown in FIG. 1, except for a difference in transfer of heat from the downstream product stream 42 within the process. In particular, in this embodiment, the first intermediate stream 30 is heated by transferring heat from the downstream product stream 42 to the first intermediate stream 30, e.g., using a second heat exchanger 64, prior to heating the first intermediate stream 30 with the energy from the source external to the process, e.g., using the first heater 54. In this embodiment, the transfer of heat from the downstream product stream 42 to the first intermediate stream 30 produces a partially cooled downstream product stream 66, and heat is subsequently transferred from the partially cooled downstream product stream 66 to the naphtha feed stream 12 using, e.g., the first heat exchanger 53.

Figure 3:
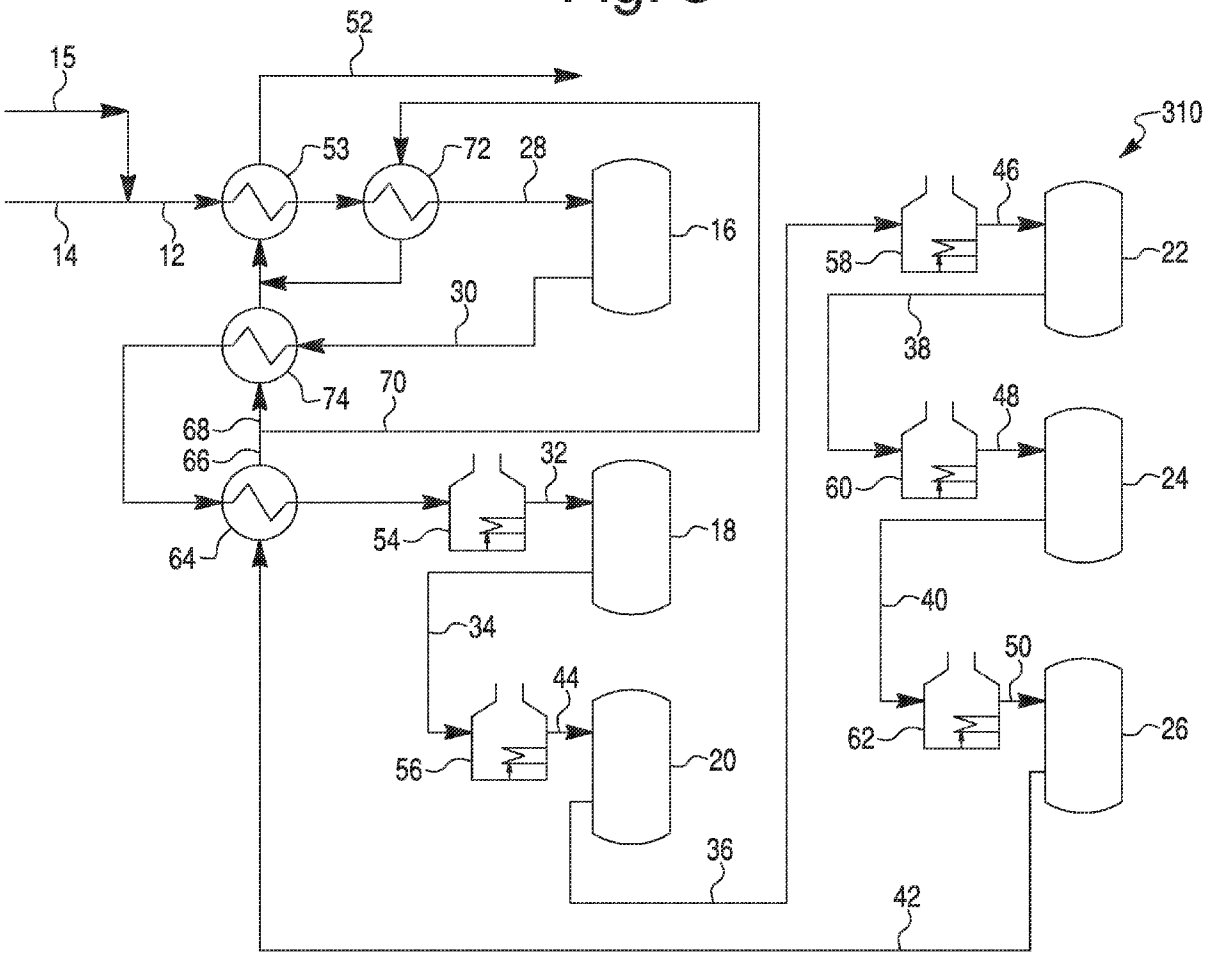
FIG. 3 is a schematic diagram of an apparatus and a process for producing aromatic compounds from a naphtha feed stream in accordance with another exemplary embodiment.

Another embodiment of a process for producing aromatic compounds from a naphtha feed stream 12 will now be addressed with reference to another exemplary apparatus 310 for producing aromatic compounds as shown in FIG. 2. In this embodiment, the process is conducted in the same manner as the process that is described above in the context of the apparatus 210 shown in FIG. 2, except for further differences in transfer of heat within the process. In particular, in this embodiment, the partially cooled downstream product stream 66 is split into separate partially cooled downstream product streams 68, 70. Heat is separately transferred from the separate partially cooled downstream product streams 68, 70 to the naphtha feed stream 12. In particular, one of the separate partially cooled downstream product streams 70 is provided to a third heat exchanger 72 that is adapted to transfer heat to the naphtha feed stream 12 and that is disposed between the first heat exchanger 53 and the first reformer 16. The other of the separate partially cooled downstream product streams 68 is provided to a fourth heat exchanger 74 that is adapted to transfer heat to the first intermediate stream 30 and that is disposed between the first reformer 16 and the second heat exchanger 64. With the configuration shown in FIG. 3, even further efficiency of heat transfer from the downstream product stream 42 may be realized.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A process for producing aromatic compounds from a naphtha feed stream, wherein the process comprises:

heating the naphtha feed stream to produce a heated naphtha feed stream;

reforming heated naphtha feed stream within a plurality of adiabatic endothermic reforming stages arranged in series to produce a downstream product stream, wherein the plurality of adiabatic endothermic reforming stages are operated at ascending reaction temperatures;

wherein heating the naphtha feedstream consists of transferring heat from the downstream product stream to the naphtha feed stream to the first reaction temperature exclusively through transferring heat from the downstream product stream to produce the heated naphtha feed stream and a cooled downstream product stream.

2. The process of claim 1, wherein the plurality of reforming stages comprises a first reforming stage and a second reforming stage, and wherein reforming the heated naphtha feed stream comprises reforming the heated naphtha feed stream in the first reforming stage operated at a first reaction temperature to produce a first intermediate stream.

3. The process of claim 2, further comprising passing the heated naphtha feed stream to the first reforming stage after heating the naphtha feed stream, and wherein the heated naphtha feed stream is passed to the first reforming stage in the absence of heating through energy input external to the process.

4. The process of claim 2, further comprising heating the first intermediate stream to produce a heated first intermediate stream.

5. The process of claim 4, further comprising reforming the heated first intermediate stream in the second reforming stage, wherein the second reforming stage is operated at a second reaction temperature greater than the first reaction temperature.

6. The process of claim 5, wherein heating the first intermediate stream comprises heating the first intermediate stream with energy from a source external to the process.

7. The process of claim 6, wherein heating the first intermediate stream further comprises transferring heat from the downstream product stream to the first intermediate stream prior to heating the first intermediate stream with the energy from the source external to the process.

8. The process of claim 7, wherein transferring heat from the downstream product stream to the first intermediate stream produces a partially cooled downstream product stream, and wherein transferring heat from the downstream product stream to the naphtha feed stream comprises transferring heat from the partially cooled downstream product stream to the naphtha feed stream.

9. The process of claim 8, further comprising splitting the partially cooled downstream product stream into separate partially cooled downstream product streams, and wherein transferring heat from the partially cooled downstream product stream to the naphtha feed stream comprises separately transferring heat from the separate partially cooled downstream product streams to the naphtha feed stream.

10. The process of claim 5, wherein heating the first intermediate stream comprises heating the first intermediate stream to the second reaction temperature that is at least 50° C. higher than the first reaction temperature.

11. The process of claim 5, wherein the plurality of reforming stages further comprises one or more additional reforming stages, wherein reforming the heated first intermediate stream produces a second intermediate stream, and wherein the second intermediate stream and any subsequent intermediate streams are heated to form heated intermediate streams that are reformed in the one or more additional reforming stages.

12. The process of claim 11, wherein the second reforming stage and the one or more additional reforming stages are operated at about the same reaction temperature.

13. The process of claim 11, wherein the second intermediate stream and any subsequent intermediate streams are exclusively heated with energy from a source external to the process.

14. The process of claim 11, wherein the downstream product stream is produced from a terminal reforming stage of the plurality of reforming stages.

15. A process for producing aromatic compounds from a naphtha feed stream, wherein the process comprises:

providing a plurality of adiabatic reformers including a first adiabatic endothermic reformer and a second adiabatic endothermic reformer, wherein the reformers are arranged in series;

heating the naphtha feed stream to a first reaction temperature to produce a heated naphtha feed stream;

passing the heated naphtha feed stream to the first reformer operated at the first reaction temperature to produce a first intermediate stream;

passing the first intermediate stream to the second reformer operated at a second reaction temperature higher than the first reaction temperature to produce a second intermediate stream;

producing a downstream product stream from the second intermediate stream using a terminal reformer of the plurality of reformers;

wherein heating the naphtha feedstream consists of transferring heat from the downstream product stream to the naphtha feed stream to produce the heated naphtha feed stream and a cooled downstream product stream, and wherein the naphtha feed stream is heated to the first reaction temperature exclusively through transferring heat from the downstream product stream to the naphtha feed stream.

16. The process of claim 15, further comprising heating the first intermediate stream to produce a heated first intermediate stream.

17. The process of claim 16, wherein heating the first intermediate stream comprises heating the first intermediate stream with a first heater.

18. The process of claim 17, wherein heating the first intermediate stream further comprises transferring heat from the downstream product stream to the first intermediate stream prior to heating the first intermediate stream with the first heater.

19. An apparatus for producing aromatic compounds from a naphtha feed stream, wherein the apparatus comprises:

a plurality of reformers consisting of up to six reformers including a first adiabatic reformer and a second adiabatic reformer, wherein the reformers are arranged in series and wherein the plurality of reformers are adapted to produce a downstream product stream from a terminal reformer of the plurality of reformers;

a first heat exchanger disposed upstream of the first adiabatic reformer and adapted to transfer heat from the downstream product stream to the naphtha feed stream;

a first heater disposed between the first adiabatic reformer and the second adiabatic reformer for heating a first intermediate stream produced by the first adiabatic reformer;

wherein the apparatus is free from a heater disposed between the first heat exchanger and the first adiabatic reformer.

* * * * *